United States Patent [19]

Ueberreiter et al.

[11] Patent Number: 4,703,858

[45] Date of Patent: Nov. 3, 1987

[54] APPARATUS FOR TESTING AND SORTING OBLONG, ELECTRONIC COMPONENTS, MORE PARTICULARLY INTEGRATED CHIPS

[75] Inventors: Ekkehard Ueberreiter, Zorneding; Hans H. Willberg, Munich, both of Fed. Rep. of Germany

[73] Assignee: Multitest Elektronische Systeme GmbH, Rosenheim, Fed. Rep. of Germany

[21] Appl. No.: 921,832

[22] Filed: Oct. 21, 1986

Related U.S. Application Data

[63] Continuation of Ser. No. 814,593, Jan. 2, 1986, abandoned, which is a continuation of Ser. No. 627,861, Jul. 5, 1984, abandoned.

[51] Int. Cl.[4] ..... B07C 5/34

[52] U.S. Cl. ..... 209/573; 221/13; 324/158 F

[58] Field of Search ..... 209/571, 573–575, 209/917, 546, 548, 549, 551; 221/13, 259, 260, 277; 324/73 R, 73 AT, 73 PC, 158 F

[56] References Cited

U.S. PATENT DOCUMENTS

| | | | |
|---|---|---|---|
| 1,835,595 | 12/1931 | Friedrichs | 221/259 X |
| 3,005,539 | 3/1956 | Wellington | 198/803.8 |
| 3,189,220 | 6/1965 | Mullaney | 221/259 X |
| 3,532,201 | 10/1970 | McConnell | 193/35 A |
| 3,677,401 | 7/1972 | Chaparro et al. | 209/571 X |
| 3,701,021 | 10/1972 | Issac et al. | 324/158 F |
| 3,716,786 | 2/1973 | Gearin | 324/158 F |
| 3,727,757 | 4/1973 | Boissicat | 209/573 |
| 3,896,935 | 7/1975 | Hjelle et al. | 209/573 |
| 4,000,798 | 1/1977 | Cedrone | 193/40 |
| 4,170,290 | 10/1979 | Frisbie et al. | 198/524 |
| 4,234,418 | 11/1980 | Boissicat | 209/545 X |
| 4,316,754 | 2/1982 | Hinchcliffe et al. | 198/347 |
| 4,478,352 | 10/1984 | Amundson et al. | 221/13 |

FOREIGN PATENT DOCUMENTS

| | | | |
|---|---|---|---|
| 0007650 | 2/1980 | European Pat. Off. | 209/573 |
| 2855913 | 6/1980 | Fed. Rep. of Germany . | |

OTHER PUBLICATIONS

"Module Test and Handling System"; *IBM Technical Disclosure Bulletin;* vol. 16, No. 11, pp. 3653–3654; L. D. House; Apr. 1974.

*Primary Examiner*—Robert B. Reeves
*Assistant Examiner*—Edward M. Wacyra
*Attorney, Agent, or Firm*—Fitzpatrick, Cella, Harper & Scinto

[57] ABSTRACT

In the case of an apparatus for testing and sorting oblong, electronic components, more particularly integrated chips, the components, which have been supplied in a row, are separated by means of a separating arrangement. The separating arrangement consists of a belt conveyer, which is arranged above a slideway for the components which have been supplied and which takes hold of the components which have been supplied and pushes them forward on the slideway. A control signal, which is emitted by a detecting arrangement which is arranged after the separating arrangement, is used for the purpose of stopping the belt conveyer so that the component, which has just been delivered by the belt conveyer, can, in the first instance, be tested. After testing has taken place, the belt conveyer is set in operation again.

5 Claims, 3 Drawing Figures

APPARATUS FOR TESTING AND SORTING OBLONG, ELECTRONIC COMPONENTS, MORE PARTICULARLY INTEGRATED CHIPS

This application is a continuation of application Ser. No. 814,593 filed Jan. 2, 1986 now abandoned, which is a continuation of application Ser. No. 627,861 filed Jul. 5, 1984 (now abandoned).

CROSS REFERENCE TO RELATED APPLICATION

This application discloses subject matter related to copending application Ser. No. 814,595 filed Jan. 2, 1986 in the name of Ekkehard Ueberreiter and entitled "Apparatus for Testing and Sorting Oblong, Electronic Components, more Particularly Integrated Chips.

TECHNICAL FIELD OF THE INVENTION

The invention relates to an apparatus for testing and sorting oblong, electronic components, more particularly integrated chips, having at least one feed channel, through which the components are supplied in a row, having a separating arrangement connected thereto for the components which have been supplied, having a testing arrangement connected thereto for the separating components, having a detecting arrangement, which is positioned between the separating arrangement and the testing arrangement and which responds to the separated components which are moving past, and having a distributing or sorting arrangement for the components which have been tested, which arrangement is connected to the testing arrangement.

An apparatus of this kind for testing and sorting integrated chips is known (EP Offenlegungsschrift No. 7650). The separating arrangement of this known apparatus consists of a rotatable component which is arranged in the conveying path of the integrated chips and which has a receiving opening for, in each case, one chip. The depth of the receiving opening may be adjusted exactly to suit the length of the processed chips. In a first position of the rotatable component the receiving opening is brought into alignment with a feed channel for the chips so that one chip can slide into the receiving opening. The component is then rotated in such a way that the receiving opening is brought into alignment with an outlet channel so that the chip, which is located in the receiving opening, can slide out of the latter into the outlet channel. A light barrier, which responds to the chips delivered from the rotatable component and which signals when the receiving opening of the rotatable component is unloaded, is provided between the testing arrangement and the rotatable component. The separating apparatus described above is complicated in terms of construction and must be readjusted in each case when chips of differing length are processed.

There is known, furthermore, an apparatus for testing and sorting electronic chips (U.S. Pat. No. 37 27 757) wherein the separating arangement consists of three stopping elements which are arranged in tandem in the conveying path of the chips. Each stopping element is actuated by an electromagnet. The stopping elements are controlled according to a specified program in mutual coordination in such a way that they either clear the conveying path for the chips or obstruct the conveying path by being placed in front of a chip or hold a chip by pressing upon the latter whilst forming a frictional engagement. Even this separating arrangement is expensive in terms of construction. The control program for the electromagnets, which actuate the stopping elements, must be modified here as well depending upon the length of the chips handled.

OBJECT OF THE INVENTION

The underlying object of the invention is to simplify constructionally the component separating arrangement of an apparatus of the type referred to above, and to construct it in such a way that components of differing length can be processed without carrying out any modifications.

SUMMARY OF THE INVENTION

The object is achieved according to the invention by a separating arrangement comprising a belt conveyer, which is arranged above a slideway for the components which have been supplied and which takes hold of the components which have been supplied and pushes them forward on the slideway, and by a control signal, emitted by a detecting arrangement and used to stop the belt conveyer.

Components of differing length can be processed on account of the combination of the belt conveyer and the detecting arrangement. The detecting arrangement can thereby be positioned in such a way that the control signal for stopping the belt conveyer is emitted when one component is set free and the next component, which has been transported forward by the belt conveyer, has not yet been set free. There is no need to make adjustments to adapt to the length of the processed components.

A light or photo-electric barrier cell is advantageously used as an detecting arrangement.

In order that components of differing thickness may be processed, it is proposed, furthermore, that the belt conveyer has a pressure elastic or compressible conveying belt. The practicability of processing components of differing thickness is improved further if, according to another development, the conveying belt of the belt conveyer is inclined in the direction of movement of the components. In order to avoid the need of means for carrying away the components after the separation, it is proposed, furthermore, that the slideway be inclined in such a way that the separated components, after release by the belt conveyer, automatically come away from the belt conveyer by the effect of gravity and move to the testing arrangement.

BRIEF DESCRIPTION OF THE DRAWINGS

An exemplary embodiment of the invention is described in the following with the aid of the drawings, in which.

DETAILED DESCRIPTION OF THE PREFERRED EMBODIMENT

Figure 1:
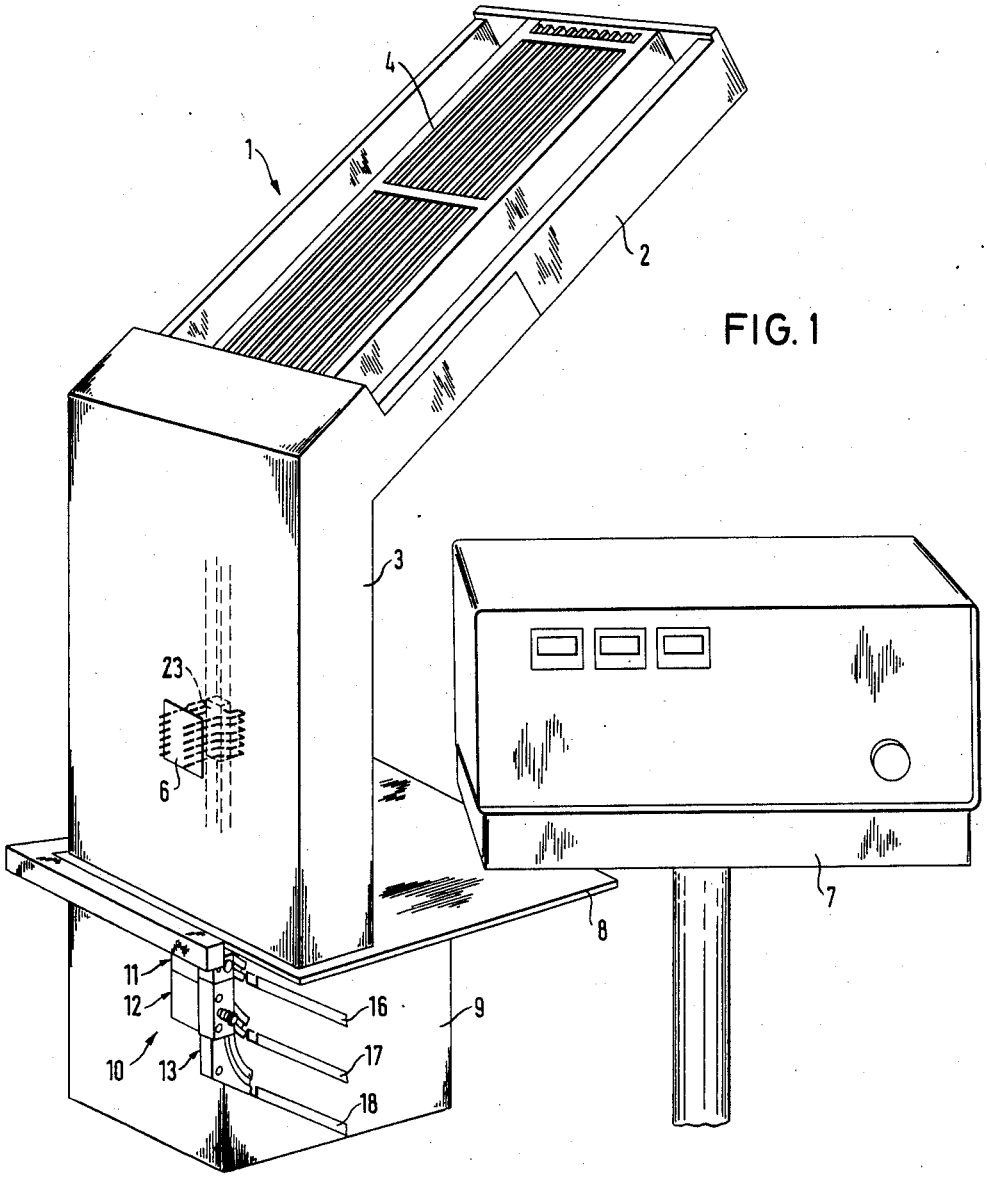
FIG. 1 shows a perspective partial view of an apparatus according to the invention.

FIG. 1 shows an apparatus 1 which serves the purpose of delivering components, that is, more particularly integrated chips (IC), from a delivery device 2, containing a plurality of these components, to a receiving device shown in the lower part of FIG. 1, but which is not illustrated in greater detail. The components may thereby be supplied in or on magazine rods which are placed upon corresponding rods 4 in the delivery device 2 or which may be formed by these rods 4. At this point, it may be observed that the delivery device 2 of the apparatus represented in FIG. 1 is arranged obliquely, so that the components, which are contained in this delivery device 2, are able to move by the effect of gravity. A separating arrangement, which will be explained further in greater detail with the aid of FIGS. 2 and 3, is, however, inserted into the path of motion of the components.

In addition to the delivery device 2, a guiding arrangement 3, which can, for example, be a heat chamber and in which the individual components, such as the component denoted at 23 in FIG. 1, can undergo testing, forms part of the apparatus, according to FIG. 1. The testing takes place by means of a test adapter 6. The mode of operation of the latter does not need to be discussed here in greater detail. This test adapter 6 is connected with a measuring arrangement 7, for example, by way of a corresponding connecting cable.

According to FIG. 1, a routing arrangement 10 is connected to the guiding arrangement 3. This routing arrangement 10 is mounted, according to FIG. 1, on a supporting block 9 which is connected with the guiding arrangement 3 by way of a supporting plate 8. Two routing parts 11 and 12, which are arranged one above the other and which may be displaced in each case by means of an appertaining electromagnet, form part of the routing arrangement 10, as shown in FIG. 1. Moreover, an end part 13 forms a further part of the routing arrangement 10. Outlet channels 16, 17 and 18 for the chips extend from the routing parts 11, 12 and the end part 13.

Figure 2:
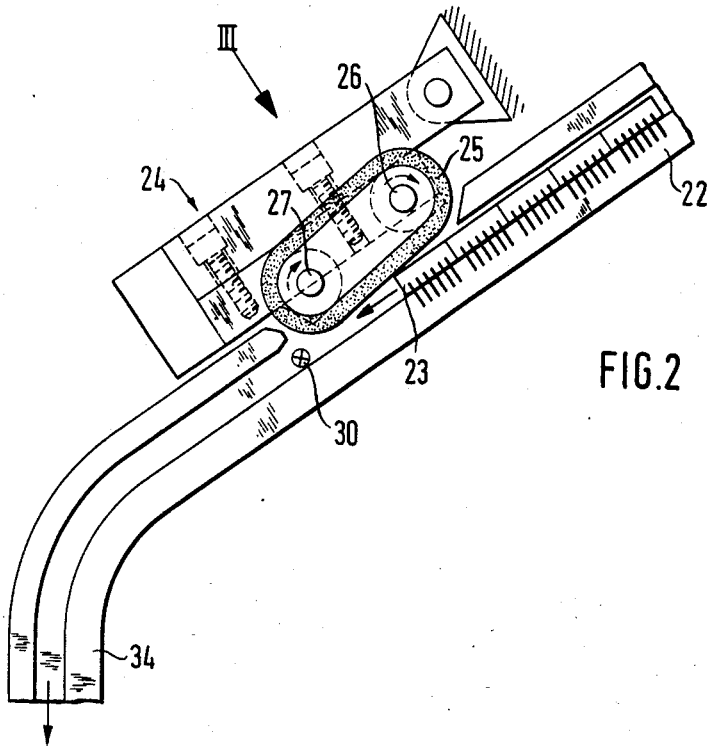
FIG. 2 shows an enlarged side view of a separating arrangement of the apparatus represented in FIG. 1.
Figure 3:
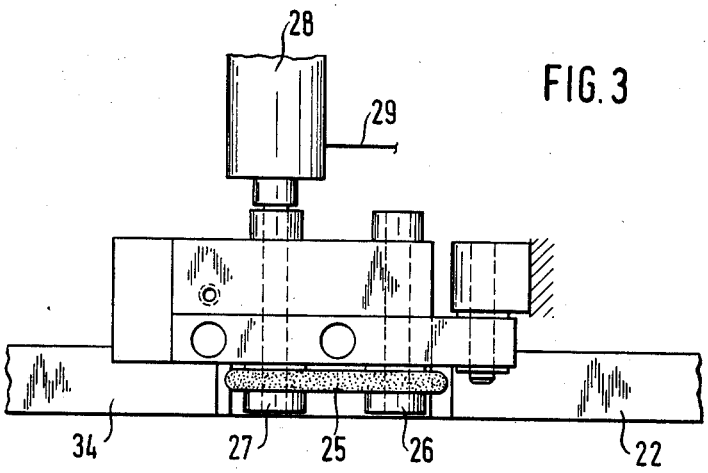
FIG. 3 shows a top view of the separating arrangement, which is represented in FIG. 2, in the direction of the arrow III which is marked on in FIG. 2.

The separating arrangement, which is used in the case of the apparatus according to FIG. 1, is illustrated in greater detail in FIG. 2 in an enlarged side view. As is clear, the separating arrangement 24 is positioned in the region of a feeding arrangement which has a receiving channel 22 in which several components 23 are one after the other. This receiving channel can be one of the channels which are denoted at 4 in FIG. 1. The separating arrangement comprises a belt conveyer having an elastic conveying belt which, for example, can be a continuous rubber band which runs around rollers 26 and 27. A driving motor 28, which is supplied with its supply voltage by way of a connecting line 29, is connected to the shaft of the roller 27, as shown in FIG. 3.

As FIG. 2 shows, the conveying belt 25 of the belt conveyer is arranged so that it is inclined in the direction of movement of the components 23. As a result, the conveying belt 25 presses the components 23, which have been supplied, into the receiving channel 22 which belongs to the feeding arrangement. The result of this is that the components 23 cannot, of their own accord, slide along the receiving channel and reach a guiding channel 34 which leads to the receiving device. On the contrary, the conveying belt 25 must for this purpose first be put into motion, the said conveying belt then forwarding the components 23 one by one and one after another.

In addition, a detecting arrangement 30 is shown in FIG. 2. This detecting arrangement 30 detects the passing of the respective component 23, for which purpose the detecting arrangement may, for example, be a light barrier cell. The position of the light barrier cell is then chosen so that a component 23, which has just been released by the conveying belt 25, frees the light barrier before a component, which is to be subsequently delivered by the conveying belt 25, interrupts the light barrier with its front edge. A control signal, which is obtained from the light barrier, can thereby be used for the control of the belt conveyer 24. The driving motor 28 can, for example, be stopped after the light barrier has detected the passing movement of a component 23.

The mode of operation of the apparatus is a follows: the separating arrangement releases in each case just one single component from the delivery device 2. This component then falls of its own accord down a guiding or testing channel in order to be then subsequently examined by means of the test adapter 6. Not until the component has been subsequently released by means of any conventional stopping arrangement, which is not described here in greater detail, can the separating arrangement then be set in operation again in order to deliver a further component. The switch arrangement is thereby controlled by the measuring arrangement 7 in such a way that the components, which have been delivered from the stopping arrangement, are forwarded to the receiving device in order, for example, to be sorted according to various criteria of quality.

It can also be observed that the component magazine, which is present in the case of the delivery device 2 according to FIG. 1, may be transported in a lateral direction, that is, exactly at that point when in spite of the movement of the continuous rubber band 25 of the belt conveyers 24, the detecting arrangement 30 emits no signal over a certain time span. This is to be interpreted as a sign of the fact that a magazine rod, from which components have previously been removed, is at this stage empty. In this case, a further magazine rod having a corresponding supply of components can be shifted into the path of motion of the belt conveyers 24.

What is claimed is:

1. Apparatus for testing and sorting oblong, electronic components, more particularly integrated chips, said apparatus comprising means forming at least one said channel, through which the components are supplied in a row, a separating arrangement for separating the components which have been supplied from the feed channel, a testing arrangement for testing the separated components, a detecting arrangement positioned between the separating arrangement and the testing arrangement for detection of the separated components which move past, and a sorting arrangement for the components which have been tested, said sorting arrangement being connected to the testing arrangement, characterized in that the said separating arrangement comprises a belt conveyer positioned above a slideway for the components said belt conveyor being arranged to take hold of the components which have been supplied and push them forward on the sideway, and said slideway being inclined in such a way that the separated components, after release by the belt conveyor, automatically move away from the belt conveyer and toward said testing arrangement by gravitational force, and said detecting arrangement being arranged to stop the belt conveyer in response to separation of each component therefrom.

2. Apparatus according to claim 1, wherein the detecting arrangement is a light barrier cell.

3. Apparatus according to claim 2, wherein the belt conveyer includes a pressure compressible conveying belt.

4. Apparatus according to claim 1, wherein the belt conveyer includes a pressure compressible conveying belt.

5. Apparatus according to claim 4, wherein the conveying belt of the belt conveyer is inclined in the direction of movement of the components.

* * * * *